United States Patent [19]

Yoneda

[11] Patent Number: 4,711,188

[45] Date of Patent: Dec. 8, 1987

[54] PREPARATORY DEVICES FOR A POCKET SEWING MACHINE

[75] Inventor: Katsuki Yoneda, Nishinomia, Japan

[73] Assignee: Satoh Seiki Co., Ltd., Japan

[21] Appl. No.: 810,504

[22] Filed: Dec. 19, 1985

[30] Foreign Application Priority Data

Jan. 17, 1985 [JP] Japan ..... 60-6737

[51] Int. Cl.[4] ..... D05B 3/12; D05B 33/00

[52] U.S. Cl. ..... 112/104; 112/113; 112/121.29

[58] Field of Search ..... 112/104, 113, 121.29, 112/121.15

[56] References Cited

U.S. PATENT DOCUMENTS 2,560,186 7/1951 Plopper ..... 112/113 X 4,305,338 12/1981 Adamson ..... 112/113

4,416,204 11/1983 Kaze ..... 112/68

4,527,491 7/1985 Block et al. ..... 112/104

4,541,352 9/1985 Boser et al. ..... 112/113 X 4,543,895 10/1985 Tocchio ..... 112/104

*Primary Examiner*—H. Hampton Hunter

*Attorney, Agent, or Firm*—Larson and Taylor

[57] ABSTRACT

An addition to a conventional sewing machine comprising a preparatory device for properly positioning cloths for the next cycle while the machine is undergoing a current sewing cycle. The preparatory device is movably provided with elements for pressing a suit fabric and for supplying a pocket cloth such that movements of the preparatory device as well as such portions thereof facilitate setting the fabric and the pocket cloth at a starting position for the sewing cycle.

1 Claim, 5 Drawing Figures

PREPARATORY DEVICES FOR A POCKET SEWING MACHINE

FIELD OF THE INVENTION

This invention relates to a sewing machine for forming a pocket on a tailoring suit fabric. More particularly, it relates to preparatory devices annexed to a pocket sewing machine.

BACKGROUND OF THE INVENTION

In a conventional sewing machine a pair of base presses move over a work surface in the sewing direction and then up away from the work surface for returning to a starting position. A pocket cloth bridges over these base presses and is pushed down between them by a T-shaped center press, after which a pair of folders fold the pocket cloth.

In the operation of this conventional sewing machine, a series of pocket forming operations are started automatically, including forward movement of the base presses with suitably positioned cloths. Meanwhile, sewing with needles and appropriate cutting of the cloth takes place successively, as shown in U.S. Pat. No. 4,416,204. Then the base presses return to the starting position.

However, in this operation, when the base presses are located at the starting position, all cloths are moved manually. It takes about six seconds for a trained operator to properly set the cloths, after which the sewing machine work, including movement of the base presses, takes about seven seconds, for a total of about twelve or thirteen seconds. This operation has the disadvantage of low efficiency since it includes idle time during sewing machine operation when the operator cannot set the cloths.

SUMMARY OF THE INVENTION

It is therefore a general object of the invention to provide means by which the setting of cloth materials for the next sewing cycle are set during the time of about seven (7) seconds or time requirement for one machine cycle.

It is another object of the invention to provide devices for supplying a fabric under press and also a pocket cloth to a starting position, in cooperation with the operation of a main sewing station.

It is a further object of the invention to provide a device for pressing a fabric temporarily during the absence of base presses or while devices operated by the main sewing station are absent from the starting position and also to provide a device for supplying a pocket cloth to be placed on a fabric through vertical up and down motions taking place alternately with the device for preparatory press for the fabric.

It is still another futher object of the invention to provide a pocket sewing machine comprising a conventional sewing station and a preparatory device movable along a sewing line and also accessible to the same, which comprises devices for preparing cloth materials to be used in the next operation cycle during a previous sewing operation.

These objects and other advantages are attained herein, in summary, by providing another preparatory device which is horizontally reciprocable on a work surface for a certain distance in the sewing direction. Said preparatory device is comprised of devices to move a preparatory press for a fabric and a tray for a pocket cloth so as to make alternating up and down motions or see-saw actions mutually when the preparatory device resides forward or remains accessibly close to the starting position for sewing, wherein the alternating up and down motion proceeds in such a sequence that the preparatory press comes, bringing a fabric piece thereunder, to a site which corresponds to the center space between the presses belonging to the main sewing devices and subsequently the tray carrying the pocket cloth comes down over the laid fabric.

DETAILED DESCRIPTION OF PREFERRED EMBODIMENTS

Figure 5:
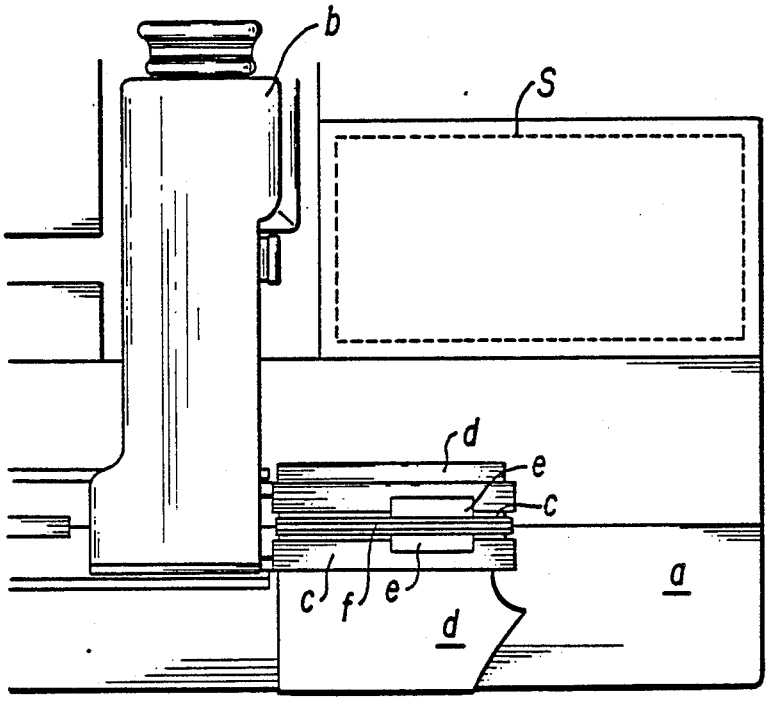
FIG. 5 is a schematic plan view of a conventional sewing machime, wherein a square S made of broken line indicates a possible reciprocating area for the preparatory device of the present invention.

Before discussing the preferred embodiments in detail, it is helpful to understand the background of the invention with reference to FIG. 5 which illustrates a conventional sewing machine to which the present invention could be applied.

FIG. 5 is a plan view of a conventional sewing machine. Item b is a sewing head equipped with sewing needles. Item a is a work surface along which the cloth materials slide. A pair of base presses c,c move along the work surface a for a predetermined distance in the direction of sewing (from right to left in FIG. 5), and they are moveable upwardly to return back to an initial starting position. A fabric d is pressed onto the work surface a under the base presses c,c at the starting position, as shown in FIG. 5. Then a pocket cloth e is placed over the base presses c,c so as to bridge the space therebetween, after which a center press f, having a T-shape, moves down between the base presses c,c to press the pocket cloth e. Then folding devices (not shown) projecting toward both sides of the T-shaped press are adapted to approach and fold the pocket cloth e. This timing provides an automatic start for a series of operations for the pocket forming cycle, which cycle includes forward movement of the base presses c,c according to a sewing program, together with appropriately placed cloth materials d,e. In the meantime, the sewing by the needles of the head b, a line cut by a knife (not shown) an end cut by a triangle knife (not shown) at a pocket edge and removal of a sewn cloth by a stacker (not shown) take place successively as described for example in U.S. Pat. No. 4,416,204. The presses c,c then return, as noted above, to finish the operation cycle. It is to be noted that the setting of the materials d,e have all been performed manually by a sewing operator when the presses c,c are at the starting position.

It is this manual setting of the cloths which creates a disadvantage to be overcome by the present invention. Setting the cloths at the preparatory stage takes about six seconds for a well trained operator, after which the sewing machine takes about seven seconds. Consequently, there is a total time of about twelve or thirteen seconds during a portion of which, the machine operation portion, the operator is sitting idle. This low operator efficiency represents a significant defect of the conventional sewing machine even though there have been enhancements in machine speed.

The invention will be hereinafter explained in detail with respect to preferred embodiments as disclosed in the drawings, by comparison to a conventional sewing machine as illustrated herein, but the invention should not be construed as limiting to disclosures of the drawings.

Figure 1:
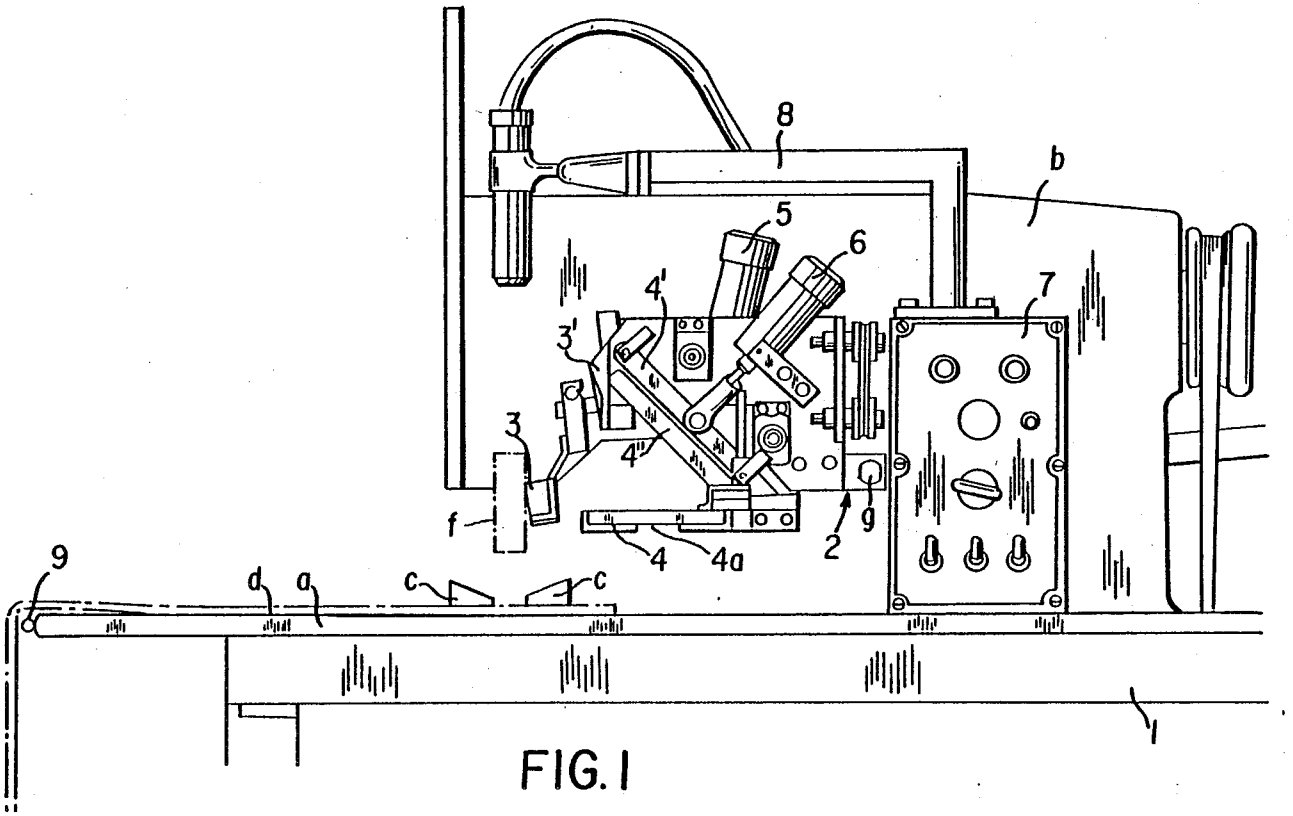
FIG. 1 is a front elevation view of an embodiment of the invention.
Figure 2:
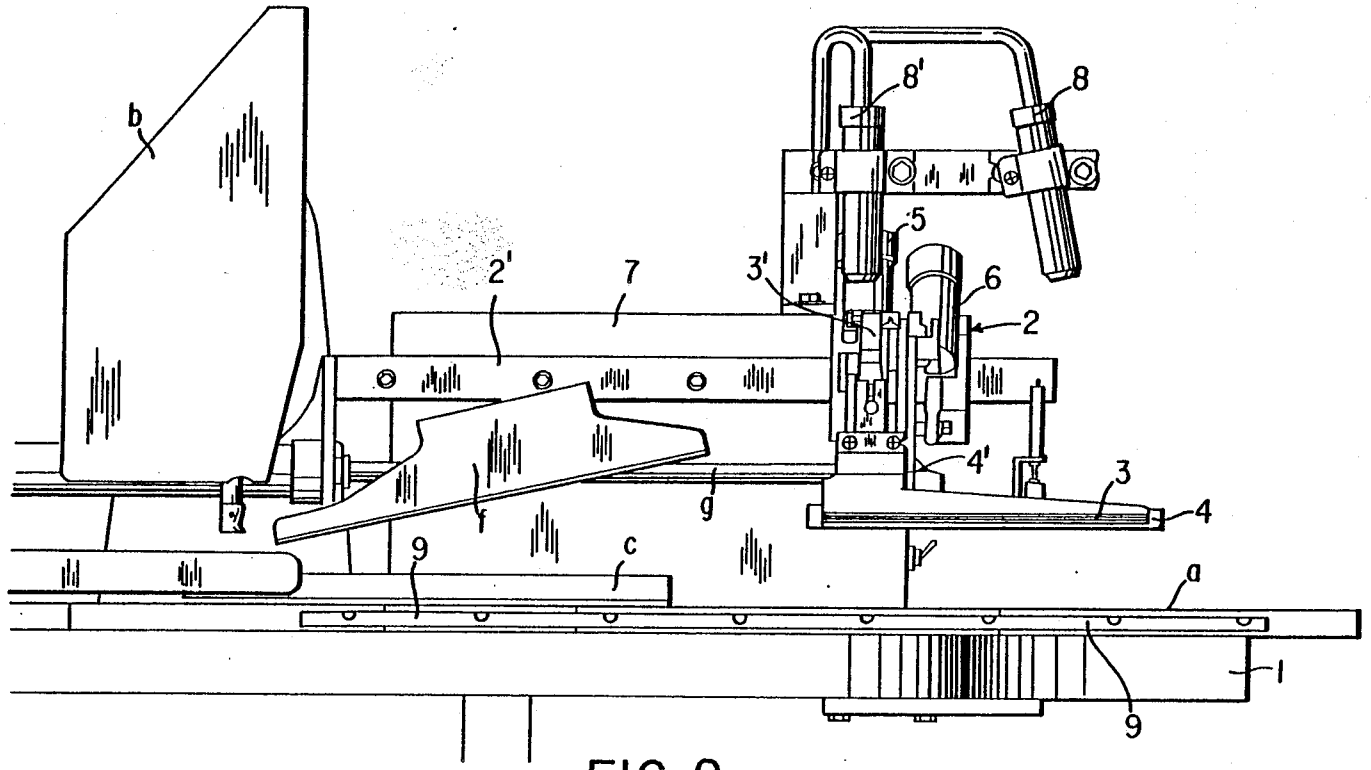
FIG. 2 is a side view of the same embodiment, showing the preparatory station being at the backward position.
Figure 4:
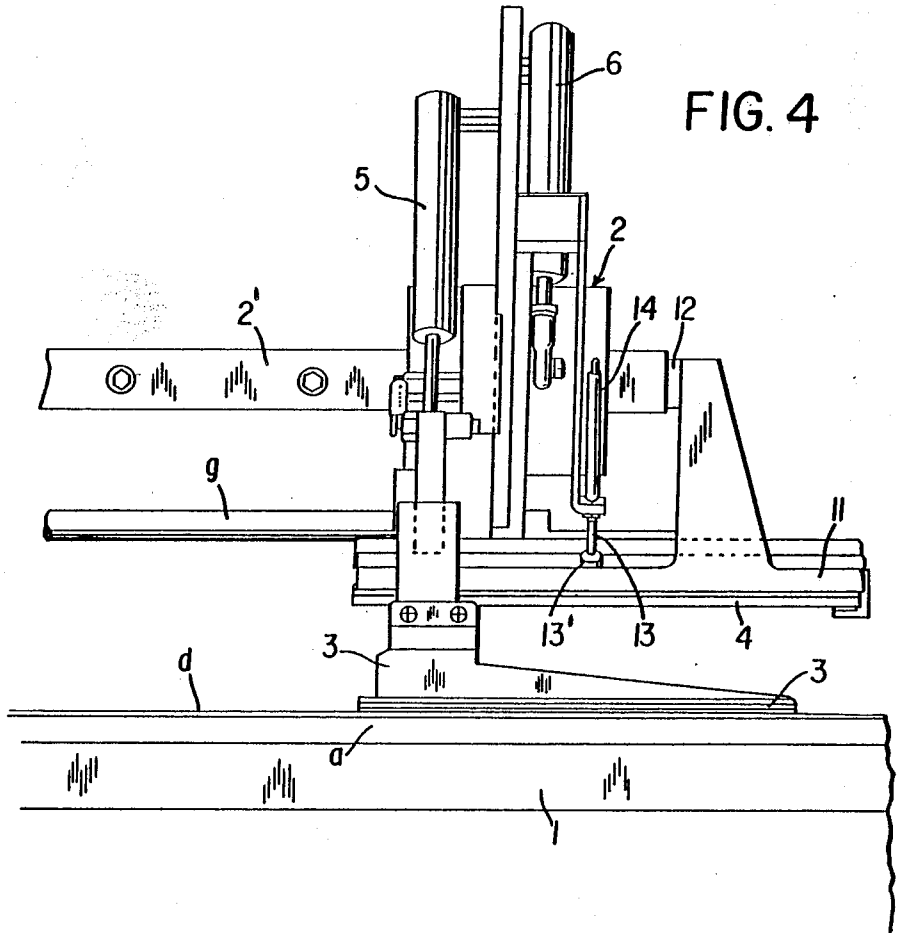
FIG. 4 is a side elevation of devices to be added to assist the feed and the holding of pocket cloths at the backward position of the preparatory device.

First it is to be noted the forward direction of sewing is from right to left in FIG. 2, FIG. 4 and FIG. 5. The backward direction is the opposite, left to right. And description now starts with the embodiment shown in FIG. 1 and FIG. 2.

In FIGS. 1 and 2, 2 is a preparatory device which is adapted to reciprocate slidably on the work surface a with guide of a rail 2' and also a guide pipe g in the sewing direction which lies horizontal in FIG. 2 and FIG. 5. The reciprocating distance thereof may be adequate for 30 to 40 cm, for instance. Said preparatory device is provided with a device for pressing a fabric, which is adapted to move up and down along a certain determined route as defined by a cam 3', and is also provided with a device for holding a tray to carry a pocket cloth, which is supported by two arms 4',4" to move up at an angle, wherein alternating up and down motions are adapted to take place mutually in sequence as noted hereinbefore. Air cylinders 5 and 6 are equipped to actuate up and down motions of these two devices, respectively.

On the stand 1, independently of the inventive devices, stands an operation box 7, which is equipped are two arms for holding marking lamps 8,8' which will monitor spots on the work surface, around the backward position of the preparatory station, to have a suit fabric set at a correct location. 9 indicates optional air blow pipes set upward along the edge line of the stand 1, where the blow pipes 9 prevent sewing materials from undesirable slip or offset during operational moves of cloth materials.

In a series of operations, the preparatory device 2 starts moving from the backward position to the forward position in accordance with, for instance, an electrical signal interconnected with operation of devices belonging to the main sewing station. Namely, said signal is received at the moment that the T-shaped press f has just moved following a forwarding move of the base presses c,c and therefore manual placements of cloth materials d,e on the work surface and the preparatory device are desirably finished before an operation cycle comes up to the stage as noted.

A series of operations as carried out by the preparatory device will be described below in detail with reference to operation of parts of the sewing station.

1. The preparatory device resides at the backward position (the right side in the square S in FIG. 5). A pocket cloth e is loaded on the tray 4.
2. A suit fabric d is set, with aid of the marking lamps 8,8', at the prescribed laying position on the work surface a or in other words, in front of the preparatory device residing at the backward position.
3. The preparatory device is set standby by a pedal action to wait for the start signal from the main sewing mechanism through some transmission system. In the meantime, the preparatory device remains pressing the suit fabric d with the press 3 at the backward position. (The suit fabric d will be slid forward on the work surface a to the position as shown in FIG. 5. See the next step 4.)
4. When the main station permits the base presses c,c to move forward as a previous cycle and immediately the T-shaped press f starts moving upward, then the signal is transmitted to the preparatory side, whereby the preparatory device 2 starts moving forward. (During a sewing cycle, blow pipes 9 are actuated if equipped as noted before.)
5. The base presses c,c release the sewn cloth materials at the most forward point and move to a height for the starting position.
6. From above the starting position where the next fabric is already set pressed by the preparatory press 3, (the preparatory device has reached the forward position which corresponds to the left hand side in the square S), the base presses c,c come down to land striding the press 3 aground, whereby the presses c,c join the press action onto the fabric d.
7. The press 3 departs upward avoiding the T-shaped press f existing above and alternately the pocket cloth tray 4 comes down to a certain point above the base presses c,c to await removal of the cloth by the T-shaped press.
8. The T-shaped press comes down onto the pocket cloth loaded on the tray 4 and pushes the cloth down through the groove 4*a* (see FIG. 1) onto the laid fabric. Then with the aid of folder plates (as noted hereinafter, but not shown), a fold for a pocket formation is produced, while the preparatory device 2 moves from its forward position to its backward position.
9. On completion of a pocket fold, a signal is generated to start the next cycle and the base presses c,c start moving forward again from the starting position.
10. Simultaneously the preparatory device 2 starts moving forward from its backward position bringing cloth materials d,e to the starting position in the same way as noted in the steps 3 and 4.

Figure 3:
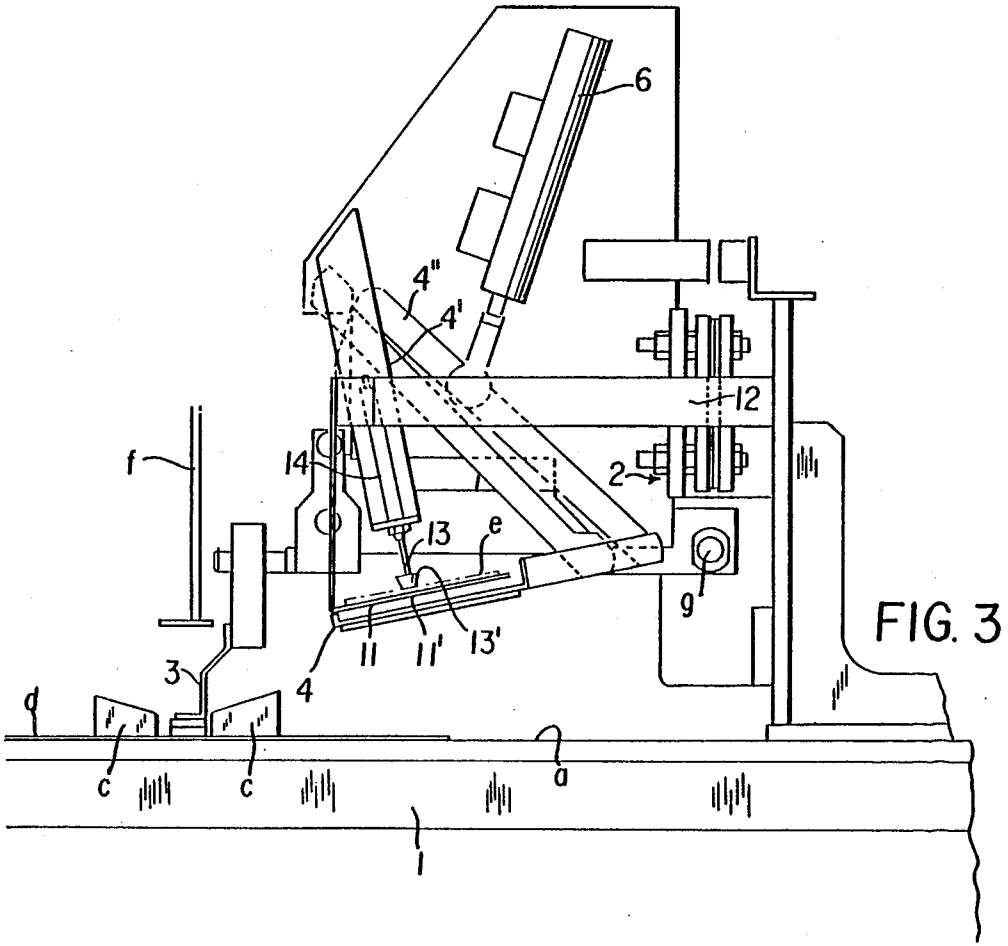
FIG. 3 is a front elevation.

In the embodiment described above, the preparatory device contributes to sewing operations by bringing fabrics to the starting position on the work surface with action of the press 3 and by bringing pocket cloths to a certain point above the laid fabrics with the action of the tray 4. Therefore, it is to be understood that, as for the fabric d, direct preparative work is allowed by activities of the preparatory device. However, as for the pocket cloth e, direct contributive work is not always possible at the same time as the loading of cloths onto the tray 4 is allowed, which situation will be improved in the next embodiment. The embodiment shown in FIGS. 3 and 4 is detailed as follows:

In FIGS. 3 and 4, 11 is a pocket cloth feeder, newly introduced, installed immovably or independently of the preparatory device 2, with support of an arm 12 to be disposed just above the tray 4 when the preparatory device 2 resides at the backward position. 13 is a reciprocable pusher with a soft headed tip 13' and 14 is an actuator cylinder therefor. These elements of 13 with 13' and 14 are new additions to the above embodiment so that the pusher 13 may push downwardly the pocket cloths loaded on the feeder 11, through a groove 11' (see FIG. 3) below onto the tray 4. (Therefore, manual loading of a pocket cloth is required onto the feeder 11 in the present embodiment.) Thereafter, the pocket cloths will be carried forward under press by the pusher tip 13', which will render more correct placements thereof at the starting position in less time.

Operative modifications as a result of introduction of the feeder 11, the pusher 13 and their relative elements will be explained with reference to the sequence steps to be made with the embodiment of FIGS. 1 and 2 as described hereinbefore.

(a) At the step 1, a pocket cloth e is loaded on the feeder 11 and the pusher 13 extends downwardly to push down the cloth onto the tray 4 where the cloth is captively held by the pusher head 13'.

(b) At the step 7, when the pocket cloth tray 4 comes down to a certain point above the base presses c,c, the pusher 13 retracts, whereby the cloth e is released to wait for the next handling by the T-shaped press f.

As is evident from the preceeding discussion, the preparatory device of the present invention is provided in addition to a conventional sewing machine with the advantage of enabling adequate setting of pocket sewing materials during the seven seconds or the like of a sewing cycle. Consequently, since the setting of fabrics is accomplished during the seven to eight seconds of the sewing cycle, rather than as an addition thereto, requiring a total cycle time of twelve to thirteen seconds, the overall operation is far more efficient and hence the task does not demand as high a level of skill. This is an effective reduction in overall cycle time of approximately 160%.

What is claimed is:

1. A pocket sewing machine comprising a sewing station and a preparatory device, said sewing station comprising a sewing needle, a cut knife, a triangle knife for an end cut, a stacker, a pair of base presses, a T-shaped center press and a cloth folder; said preparatory device being moveable along a sewing line of the sewing machine and comprising a press means for pressing a suit fabric and a supply means for supplying a pocket cloth, said sewing station and said preparatory device cooperating with each other such that while the pair of base presses of the sewing station are away from the starting position of the sewing machine, the press means of the preparatory device presses a suit fabric at the starting position of the next sewing cycle of the sewing machine and the pair of base presses return to said starting position and move upwards as the supply means for a pocket cloth moves downwardly.

* * * * *